US010343076B2

(12) United States Patent
Vargas et al.

(10) Patent No.: US 10,343,076 B2
(45) Date of Patent: Jul. 9, 2019

(54) CUSTOMIZABLE MANNEQUIN FORM

(71) Applicants: Darcy Vargas, Arlington, VA (US); Dartagnan Vargas, Arlington, VA (US)

(72) Inventors: Darcy Vargas, Arlington, VA (US); Dartagnan Vargas, Arlington, VA (US)

( * ) Notice: Subject to any disclaimer, the term of this patent is extended or adjusted under 35 U.S.C. 154(b) by 0 days.

(21) Appl. No.: 14/861,231

(22) Filed: Sep. 22, 2015

(65) Prior Publication Data

US 2016/0096115 A1 Apr. 7, 2016

Related U.S. Application Data

(60) Provisional application No. 62/059,338, filed on Oct. 3, 2014.

(51) Int. Cl.

| | |
|---|---|
| ***A63H 3/36*** | (2006.01) |
| ***A63H 3/00*** | (2006.01) |
| ***A63H 3/48*** | (2006.01) |
| ***A63H 3/28*** | (2006.01) |

(52) U.S. Cl.

CPC ..... *A63H 3/365* (2013.01); *A63H 3/006* (2013.01); *A63H 3/28* (2013.01); *A63H 3/48* (2013.01)

(58) Field of Classification Search

USPC ..... 446/97, 100, 295, 321, 391, 392, 395, 446/394

See application file for complete search history.

(56) References Cited

U.S. PATENT DOCUMENTS

| | | | | | |
|---|---|---|---|---|---|
| 1,868,209 | A * | 7/1932 | Kapernick | G09B 23/34 | 434/271 |
| 2,354,581 | A * | 7/1944 | De Jong | A63H 3/46 | 446/376 |
| 2,506,328 | A * | 5/1950 | Alger | A63H 9/00 | 24/90.1 |
| 2,699,621 | A * | 1/1955 | Levinson | G09F 19/08 | 40/427 |
| 2,831,286 | A * | 4/1958 | Eisner | B44C 1/20 | 249/112 |
| 3,090,157 | A * | 5/1963 | Lohr | A63H 3/10 | 273/DIG. 4 |
| 3,210,884 | A * | 10/1965 | Sharff | A63H 3/16 | 446/100 |
| 3,225,489 | A * | 12/1965 | Ryan | A63H 3/44 | 446/394 |

(Continued)

*Primary Examiner* — Kurt Ferstrom

(74) *Attorney, Agent, or Firm* — Daniel Boudwin; Global Intellectual Property Agency, LLC

(57) ABSTRACT

A customizable mannequin form that may be decorated according to user preference is provided. The mannequin form includes a front side resembling a face, wherein one or more accessory apertures are disposed thereon. The front side is removably secured to a rear side, thereby forming an interior volume. The front side and the rear side are removably attachable to one another via one or more fasteners. A speaker and light source are operatively connected to a power source, wherein the speaker, light source, and power source are disposed within the interior volume of the mannequin form. The mannequin form further includes multiple accessory portions that may be inserted through the one or more accessory apertures disposed on the front side in order to provide a customized appearance.

17 Claims, 4 Drawing Sheets

(56) References Cited

U.S. PATENT DOCUMENTS 3,250,910 A * 5/1966 Authier ..... F21V 3/023 40/540
3,464,146 A * 9/1969 McCurdy ..... A63H 3/12 446/100
3,520,078 A * 7/1970 Klamer ..... A63H 3/16 446/125
3,791,068 A 2/1974 Pietrowialt
4,263,743 A * 4/1981 Hanson ..... G09F 19/08 362/197
4,595,378 A * 6/1986 Sweet ..... A63H 3/16 446/321
4,596,528 A * 6/1986 Lewis ..... G09B 23/30 434/270
5,090,910 A * 2/1992 Narlo ..... G09B 23/34 434/100
5,091,833 A * 2/1992 Paniaguas ..... A63H 3/365 362/191
5,320,535 A 6/1994 Min
5,752,869 A * 5/1998 Huff ..... A63H 3/16 446/102
5,971,763 A 10/1999 Yau
6,109,921 A 8/2000 Yau
6,165,569 A * 12/2000 Cohen ..... A63H 3/50 40/411
6,176,756 B1 * 1/2001 Panec ..... A63H 3/04 446/321
6,224,234 B1 * 5/2001 Demmery ..... A45C 15/06 362/154
6,394,874 B1 * 5/2002 Kubo ..... A63H 3/14 446/321
6,758,717 B1 7/2004 Park et al.
7,410,358 B2 * 8/2008 Morehead ..... A63H 3/365 434/94
7,520,793 B2 * 4/2009 Pillai ..... A63H 3/16 446/92
8,257,132 B2 * 9/2012 Frank ..... A63H 33/06 446/121
8,540,544 B1 * 9/2013 Logue ..... A44C 5/00 446/101
8,684,743 B2 * 4/2014 Van Dalen ..... G09B 23/30 434/267
8,888,553 B2 * 11/2014 McMullen ..... A63H 3/365 446/321
8,998,670 B1 * 4/2015 De Leon ..... A63H 3/16 446/97
9,022,595 B1 * 5/2015 Schilling ..... F21V 33/0028 362/154
2003/0086260 A1 * 5/2003 Terrell ..... A23G 3/563 362/154
2007/0149089 A1 * 6/2007 De La Torre ..... A63H 3/20 446/373
2015/0283471 A1 * 10/2015 Bergemann ..... A63H 33/062 446/394

* cited by examiner

CUSTOMIZABLE MANNEQUIN FORM

CROSS REFERENCE TO RELATED APPLICATIONS

This application claims the benefit of U.S. Provisional Application No. 60/059,338 filed on Oct. 3, 2014. The above identified patent application is herein incorporated by reference in its entirety to provide continuity of disclosure.

FIELD OF THE INVENTION

The present invention generally relates to mannequin forms. More particularly, the present invention relates to mannequin forms that may be customized by the user.

BACKGROUND OF THE INVENTION

People have used dolls, mannequins, and other human-like toys or figures for centuries. Many users enjoy the act of decorating mannequins and dolls and further enjoy displaying the completed project. One application for decorating mannequins is to decorate them for holidays or occasions. Typical mannequins include facial features such as eyes, ears, nose, and mouth that are molded with the body of the mannequin. Users of such mannequins are unable to customize the facial features, limiting their application to singular uses. It is therefore desirable to provide a mannequin form having facial features that may be customized by a user.

Mannequins are often used for holiday craft projects and decorations. In particular, Halloween is a popular holiday for decorating and displaying mannequin decorations. One method of decorating mannequins for Halloween is to decorate a hollowed-out pumpkin to resemble a human face and then illuminating the hollow interior of the pumpkin via a candle. Decorating pumpkins in this manner can be messy and time consuming. Further, using a candle to light the interior of a hollowed pumpkin is a fire hazard, particularly when the decorated pumpkin is displayed indoors. Therefore, there is need for a mannequin having a hollow interior that may be decorated and safely lit from the interior thereof in order to provide a safe decorating project and display for users.

Devices exist in the prior art relating to customizable mannequins. However, these mannequins are often only customizable by applying makeup or other materials. Further, these prior art devices lack the ability to add or remove facial features based on personal preference. It is therefore desirable to provide a highly customizable mannequin form that includes accessory apertures for various facial features that may be used to achieve a desired appearance.

SUMMARY OF THE INVENTION

In view of the foregoing disadvantages inherent in the known types of mannequin forms now present in the prior art, the present invention provides a customizable mannequin form wherein the same can be utilized for providing convenience for the user when creating a customized decorative mannequin.

It is therefore an object of the present invention to provide a mannequin form having all of the advantages of the prior art and none of the disadvantages.

Another object of the present invention is to provide a mannequin form having a front side with a perimeter edge removably secured to a rear side with a perimeter edge forming an interior volume therebetween, wherein the front side is removably attachable to the rear side via one or more fasteners, said fasteners being disposed along the length of said perimeter edge of either one of the front side or the rear side.

A further object of the present invention is to provide a mannequin form having multiple accessory apertures through which a variety of accessories may be inserted and secured therethrough.

Yet another object of the present invention is to provide a mannequin form having a light source for lighting the interior of the same that is adapted to disperse light through one or more accessory apertures.

Still a further object of the present invention is to provide a mannequin form having a recording and playback device including a microphone, audio storage, and speaker disposed within an interior volume.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
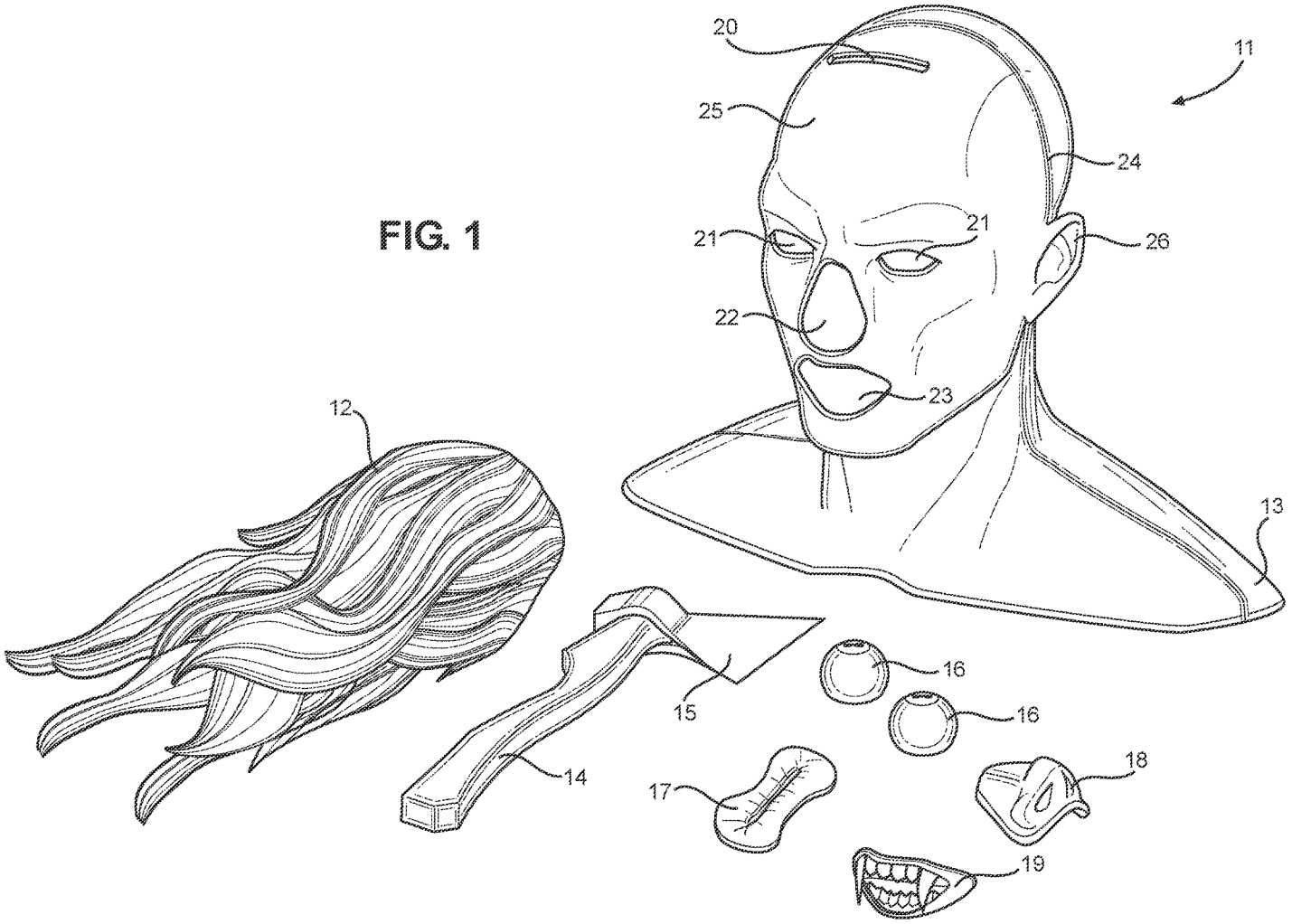
FIG. 1 shows a perspective view of a mannequin form and accessory portions according to the present invention.

Reference is made herein to the attached drawings. Like reference numerals are used throughout the drawings to depict like or similar elements of the customizable mannequin. For the purposes of presenting a brief and clear description of the present invention, the preferred embodiment will be discussed as used for a customizable mannequin form. The figures are intended for representative purposes only and should not be considered to be limiting in any respect.

Referring now to FIG. 1 there is shown a perspective view of a mannequin form and accessory portions according to the present invention. The mannequin form 11 generally comprises a front side 25 and a rear side 13. The front side 25 and the rear side 13 are removably attachable to one another along the edge 24 of each side, forming an interior volume therebetween. The front side 25 is adaptable to resemble a facial structure and may have a human-like appearance, animal-like appearance, or other appearance according to user preference.

The front side 25 comprises one or more accessory apertures disposed on various points along its surface for mounting accessories thereto. As depicted, the mannequin form 11 comprises eye apertures 21, a nose aperture 22, and a mouth aperture 23. In the illustrated embodiment, ears 26, only one of which is shown, are integrally formed with the front side 25. In alternative embodiments, the mannequin form 11 may further comprise ear apertures configured to allow the insertion of a pair of ears 26 therethrough.

A variety of possible accessory portions for the mannequin form 11 are provided. The illustrated accessory portions are not intended to be limiting but instead are an example of possible accessory portions. A wig accessory 12 is adapted to be attachable toward the top portion of the mannequin form 11. The wig accessory 12 may be attachable toward the top portion of the mannequin form 11 via an elastic band disposed around the perimeter of the wig portion 12. A pair of eyes 16 may be inserted within the eye apertures 21. A mouth accessory 19 may be inserted within the mouth aperture 23, and a nose accessory 18 may be inserted within the nose aperture 22.

In some embodiments, the front side 25 of the mannequin form 11 further comprises a wound aperture 20 for the insertion of a wound or weapon accessory therein. In the illustrated embodiment, the wound aperture 20 comprises a slot including a length greater than a width of the slot, such that the slot is configured to receive and support a blade portion 15 of an axe accessory 14. An axe accessory 14 comprising a blade portion 15 may be inserted into the wound aperture 20 at said blade portion 15 in order to simulate an injury on the mannequin form 11. A wound accessory 17 may be attached at various points on the mannequin form 11 to simulate a wound thereon. The wound accessory 17 may be attached to the mannequin form 11 via an adhesive disposed on its rear surface.

Figure 2:
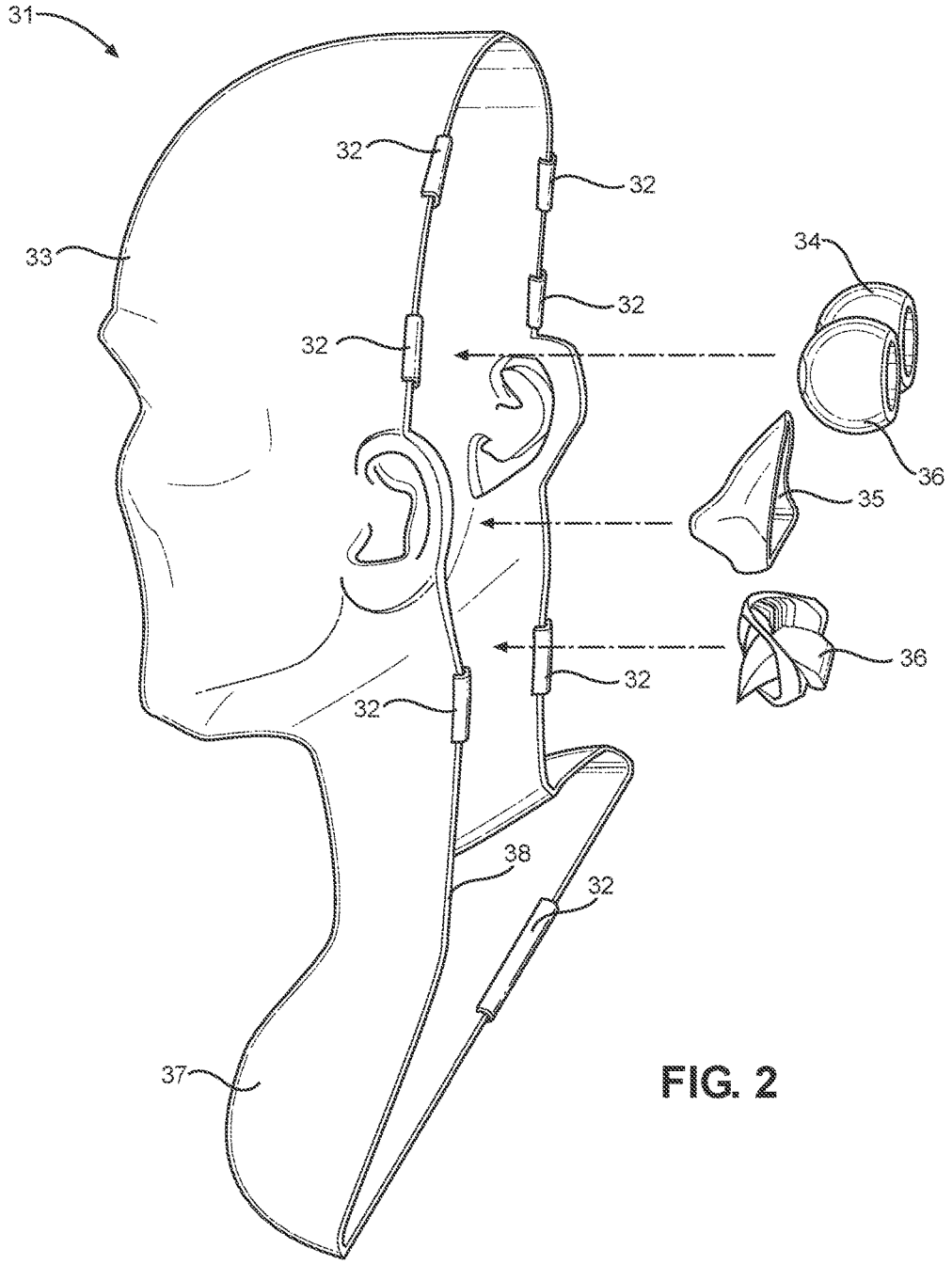
FIG. 2 shows a side perspective view of a front side of a mannequin form and accessory portions according to the present invention wherein the accessories are positioned for insertion.

Referring now to FIG. 2, there is shown a side perspective view of a mannequin form and accessory portions according to the present invention. The front side 33 comprises fasteners 32 for removably securing the rear side thereto. The front side 33 further comprises an interior volume 38 formed via attachment of the front side 33 to the rear side. In the illustrated embodiment, the fasteners 32 are depicted as magnets disposed along the edges of the front side that will be attached to the edges of the rear side. The magnets are adapted to align and removably secure to a magnetic receiving material disposed along the edges of the rear side.

The accessory portions are attached to the front side 33 via insertion through corresponding mounting apertures. For example, a mouth accessory 36 may be inserted through a mouth aperture in the front side 33. The accessory portions, such as eye accessories 34, 36, nose accessory 35, and mouth accessory 36, may releasably engage with their respective mounting apertures. In one embodiment, the insertion of the accessory portions through the accessory apertures forms a frictional connection therebetween. The accessory apertures engage with the accessory portions via the edges of the accessory apertures, which hold the accessory portions in place by exerting a constant pressure thereon. Another embodiment of the present invention may utilize magnets disposed along the edges of the accessory apertures which attract magnets disposed within the corresponding accessory portions.

Figure 3:
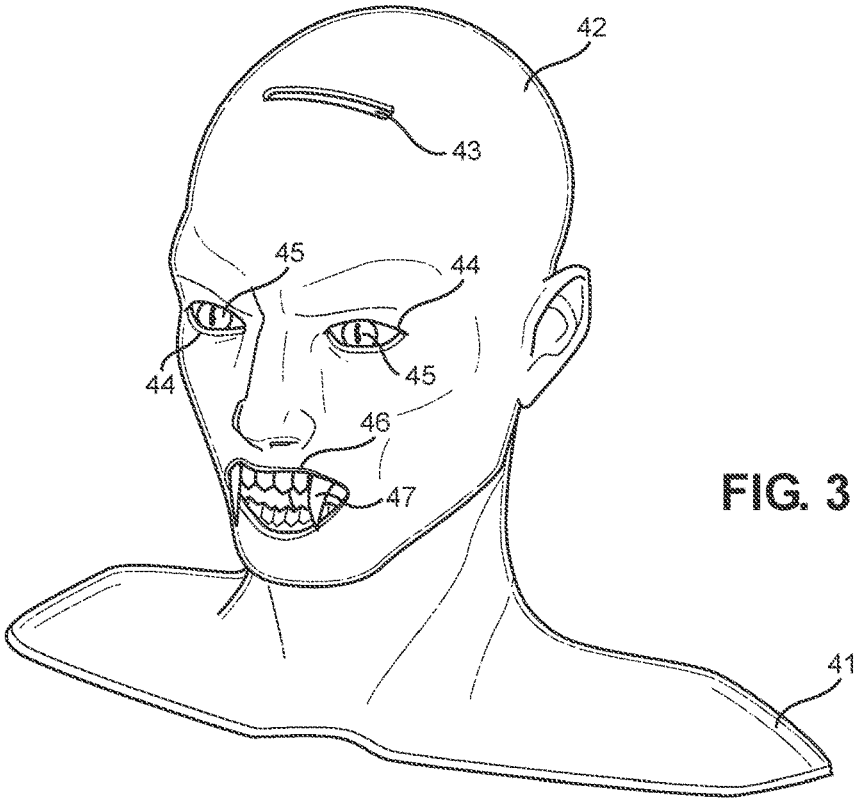
FIG. 3 shows a front view of a mannequin form with accessory portions attached thereto according to the present invention.
Figure 4:
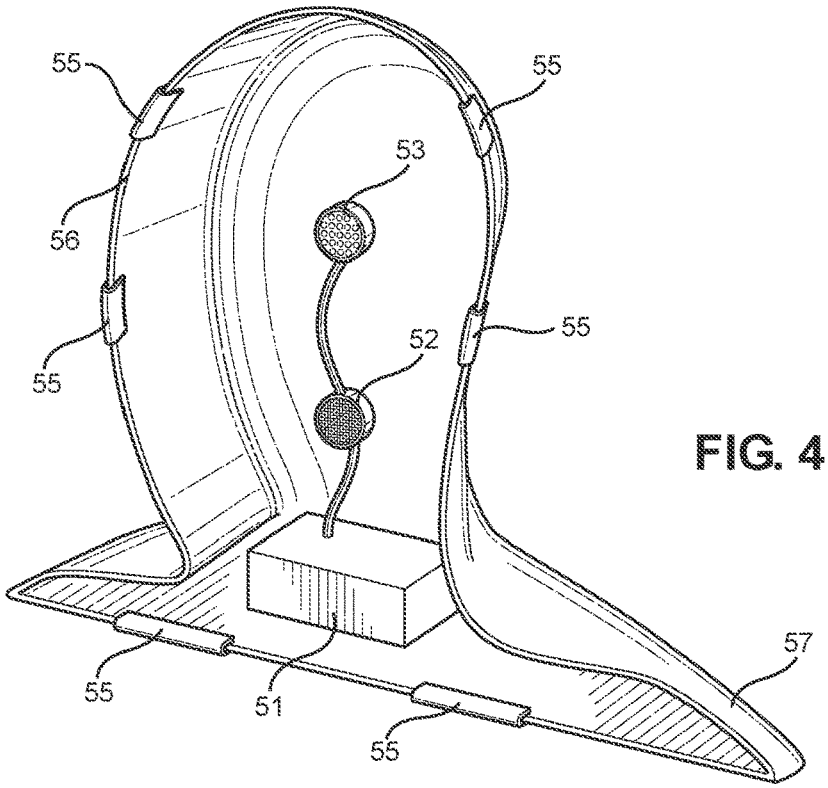
FIG. 4 shows a perspective view of the interior of a mannequin form according to the present invention.

Referring now to FIGS. 3 and 4, there is shown perspective views of the front side and rear side of a mannequin form according to the present invention. In the illustrated embodiment, the mannequin form further comprises a power source 51 disposed in the interior volume thereof. In one embodiment, the power source 51 may be a removable battery. Another embodiment of the invention may have the power source 51 be an A/C adapter connectable to an external electrical source. The power source 51 may be controlled via an integral control mechanism such as a button or switch.

A sound recording and playback mechanism 52 is further disposed within the interior volume of the mannequin form and electrically connected to the power source 51, wherein the power source is adapted to supply power thereto. The recording and playback mechanism 52 is further adapted to play sounds via an integral speaker. In one embodiment of the invention, the recording and playback mechanism 52 is configured to record sounds made by a user and emit the recording thereafter. In some embodiments, the recording and playback mechanism 52 further comprises a memory storage for storing sounds. Further, the power source 51 and sound recording and playback mechanism 52 may be disposed within the interior volume of the front side 42.

In the illustrated embodiment, a light source 53, such as an LED, is disposed within the interior volume of the mannequin form. The light source 53 is electrically connected to the power supply 51. In an alternate embodiment, the power source 51, sound recording and playback mechanism 52 and light source 53 may be disposed within the front side 42. When a user activates the power source 51 via an activation mechanism such as a switch or button, the sound recording and playback mechanism 52 emits sounds and the light source 53 produces a light, illuminating the mannequin form from within. In one embodiment of the invention, one or more accessory portions are translucent so that light may pass from the interior of the mannequin form through the accessory portions, illuminating the mannequin form and the attached accessory portions from within. In another embodiment, the mannequin form itself may be opaque or translucent, allowing light to pass through the mannequin form.

Figure 5:
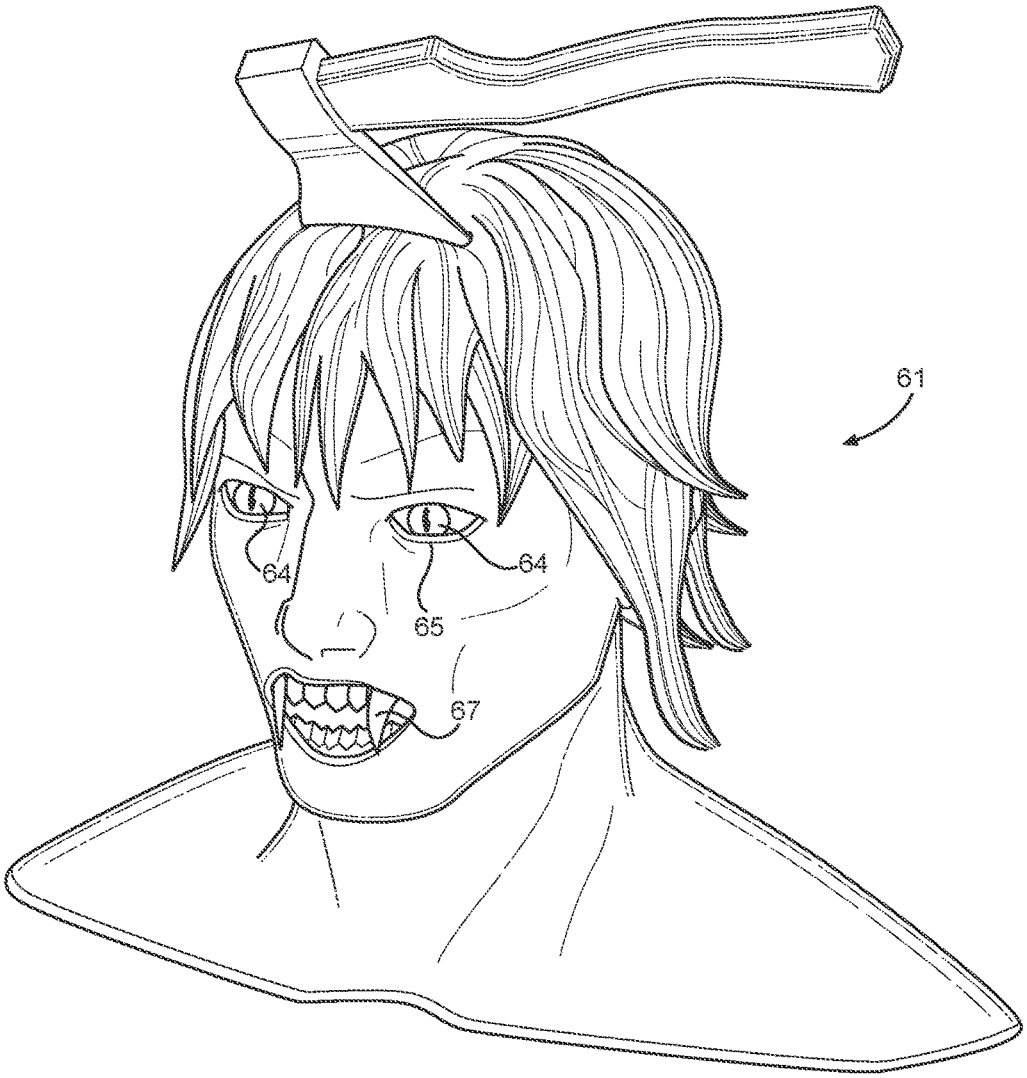
FIG. 5 shows a perspective view of a mannequin form with attached accessory portions according to the present invention.

Referring now to FIG. 5, a perspective view of a mannequin form with attached accessory components according to the present invention is shown. Users may utilize any combination of accessory portions, such as eye accessory portions 64 or a mouth accessory portion 67, for example, in order to achieve a desired appearance. Users may further customize the mannequin form 61 by adding paint or other colorants to alter the appearance of the mannequin form.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mannequin form, comprising:

a front side having a perimeter edge, an outer surface, and an interior surface;

a rear side having a perimeter edge, an outer surface and an interior surface;

one or more fasteners disposed along said perimeter edges of said front side and said rear side;

an interior volume formed by attachment of said front side and said rear side, wherein said front side and said rear side are removably attached to one another via said one or more fasteners;

a slot disposed on the front side, the slot including a length greater than a width of the slot;

an axe accessory including a blade portion, wherein the slot is configured to receive the blade portion therein;

a hair accessory including a perimeter portion having an elastic band disposed therearound, the hair accessory configured to be removably secured to an upper portion of each of the front side and the rear side when the front side and the rear side are removably attached to one another;

and one or more accessory apertures disposed on said front side, wherein said one or more accessory apertures are adapted to receive and secure an accessory portion therethrough.

2. The mannequin form of claim 1, further comprising a power source disposed within said interior volume.

3. The mannequin form of claim 2, further comprising a light source disposed within said interior volume and electrically connected to said power source.

4. The mannequin form of claim 3, further comprising a sound and playback mechanism disposed within said interior volume and electrically connected to said power source.

5. The mannequin form of claim 4, wherein said one or more fasteners are magnetic fasteners.

6. The mannequin form of claim 4, wherein said power source is a battery.

7. The mannequin form of claim 4, wherein said power source is an A/C adapter.

8. The mannequin form of claim 4, further comprising one or more accessory portions, wherein said accessory portions are adapted to be inserted through said one or more accessory apertures.

9. The mannequin form of claim 8, wherein at least one of said one or more accessory apertures is positioned substantially toward a top portion of said front side, wherein said at least one of said one or more accessory apertures is adapted to receive said one or more accessory portions therethrough.

10. The mannequin form of claim 9, wherein said one or more accessory portions comprise one or more of eyes, one or more noses, one or more ears, and one or more mouth.

11. The mannequin form of claim 9, wherein said one or more accessory portions are secured within said one or more accessory apertures via a frictional connection, wherein an edge of said one or more accessory apertures engage an edge of said one or more accessory portions.

12. The mannequin form of claim 9, wherein said one or more accessory portions are secured within said one or more accessory apertures via a magnetic connection.

13. The mannequin form of claim 9, wherein said one or more accessory portions further comprise one or more wound accessories adapted to simulate the appearance of a wound when attached to one of said first side or said rear side.

14. The mannequin form of claim 9, wherein said front side resembles a human face.

15. The mannequin form of claim 9, wherein said rear side resembles a rear portion of a human head.

16. The mannequin form of claim 9, wherein said one or more accessory portions are translucent.

17. The mannequin form of claim 9, wherein said front side and said rear side are translucent.

* * * * *